US005655930A

United States Patent [19]

Dechelette et al.

[11] Patent Number: 5,655,930

[45] Date of Patent: Aug. 12, 1997

[54] ELECTRICAL PIN FIELD ON A PRINTED CIRCUIT BOARD

[75] Inventors: Helen Dechelette, Wissous, France; Reiner DeVries, Stiphout, Netherlands

[73] Assignee: Molex Incorporated, Lisle, Ill.

[21] Appl. No.: 557,506

[22] Filed: Nov. 13, 1995

[30] Foreign Application Priority Data

Dec. 14, 1994 [EP] European Pat. Off. ..... 94119707

[51] Int. Cl.[6] ..... H01R 13/73

[52] U.S. Cl. ..... 439/571; 439/510

[58] Field of Search ..... 439/78, 189, 571, 439/572, 510, 109

[56] References Cited

U.S. PATENT DOCUMENTS

| | | | |
|---|---|---|---|
| 4,353,610 | 10/1982 | Deters | 439/510 |
| 4,567,654 | 2/1986 | Kloenne et al. | 29/876 |
| 4,589,718 | 5/1986 | Szczesny | 439/78 |
| 4,774,764 | 10/1988 | Seidel et al. | 439/409 |
| 4,872,846 | 10/1989 | Clark | 439/83 |
| 4,971,571 | 11/1990 | Puerner | 439/346 |
| 5,178,549 | 1/1993 | Neumann et al. | 439/608 |

FOREIGN PATENT DOCUMENTS

| | | |
|---|---|---|
| 0543278A1 | 11/1991 | European Pat. Off. . |
| 0578487A1 | 7/1992 | European Pat. Off. . |

*Primary Examiner*—Gary F. Paumen
*Attorney, Agent, or Firm*—A. A. Tirva

[57] ABSTRACT

An electrical pin field connector assembly includes a printed circuit board having a plurality of pins projecting from at least one side thereof. A housing is mounted over the pins with a mounting face of the housing in close proximity to the one side of the printed circuit board. The pins extend through passages in the housing. A locking member is disposed within the confines of the housing and intersects at least one of the passages. The locking member includes a gripping aperture aligned with the one passage for gripping the respective pin that extends therethrough to hold the housing mounted over the pins with the mounting face in close proximity to the printed circuit board.

7 Claims, 3 Drawing Sheets

ELECTRICAL PIN FIELD ON A PRINTED CIRCUIT BOARD

FIELD OF THE INVENTION

This invention generally relates to electrical pin fields and, particularly, to a pin field inserted in a printed circuit board.

BACKGROUND OF THE INVENTION

Pin fields formed on printed circuit boards are well known in the art. Typically, signal and/or ground contact pins are electrically connected to circuit traces on the printed circuit board by way of a press fit of compliant pin portions located within through holes in the printed circuit board. Extending away from the compliant pin portions are contact portions of the pins that are profiled for mating with terminals of a complementary electrical connecting device. Housings are positioned over the pins on one or both sides of the printed circuit board to form a connector assembly. One of the problems with such assemblies centers around the method of retaining the housings to the pin field.

For example, the most common approach for retaining the housings to the pin field is to press fit the pins into passageways of the housing which establishes an interference fit between the housing and the pins. This method has created problems in leaving some of the material of the housing on the pins themselves which could lead to an unstable contact. A solution to this problem is shown in such prior art as European Patent Application 0 578 487 A1. That publication shows the use of a separate terminal retaining block which is press fit onto the pins outside the housing. The housing, in turn, is assembled to the retaining block. This approach creates further problems in requiring expensive application tooling, and such a system is prone to damaging the pins. In addition, the separate retaining block is outside the housing and, consequently, spaces the housing from the printed circuit board. This is undesirable in applications wherein it is desirable that the housing be mounted in close proximity to one side of the printed circuit board, such as when the housing is conductive and establishes a ground plane for the pin field.

The present invention is directed to solving the myriad of problems outlined above and providing a method for retaining a housing to a pin field without mounting the housing directly onto the pins and still maintaining the housing closely juxtaposed to one side of the printed circuit board.

SUMMARY OF THE INVENTION

An object, therefore, of the invention is to provide a new and improved electrical pin field connector assembly of the character described above.

In the exemplary embodiment of the invention, a printed circuit board has a plurality of pins projecting from at least one side of the board. A housing is mounted over the pins, with a mounting face of the housing in close proximity to the one side of the printed circuit board. The pins extend through passages in the housing. The invention contemplates that a locking member be disposed within the confines of the housing and intersecting at least one of the passages. The locking member includes a gripping aperture aligned with the one passage for gripping the respective pin that extends therethrough to hold the housing mounted over the pins with the mounting face closely juxtaposed to the printed circuit board.

As disclosed in the preferred embodiment, the pins extend from the printed circuit board and the passages in the housing are in a row. The locking member is formed by an elongated locking bar having a plurality of the gripping apertures spaced lengthwise thereof for gripping a plurality of the pins. The locking bar is inserted into a channel in the housing that longitudinally intersects the row of passages in the housing. The pins are provided as ground contact pins, and the housing as well as the locking bar are of conductive material. The locking bar is of sheet metal material to facilitate forming the apertures therein as gripping apertures.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
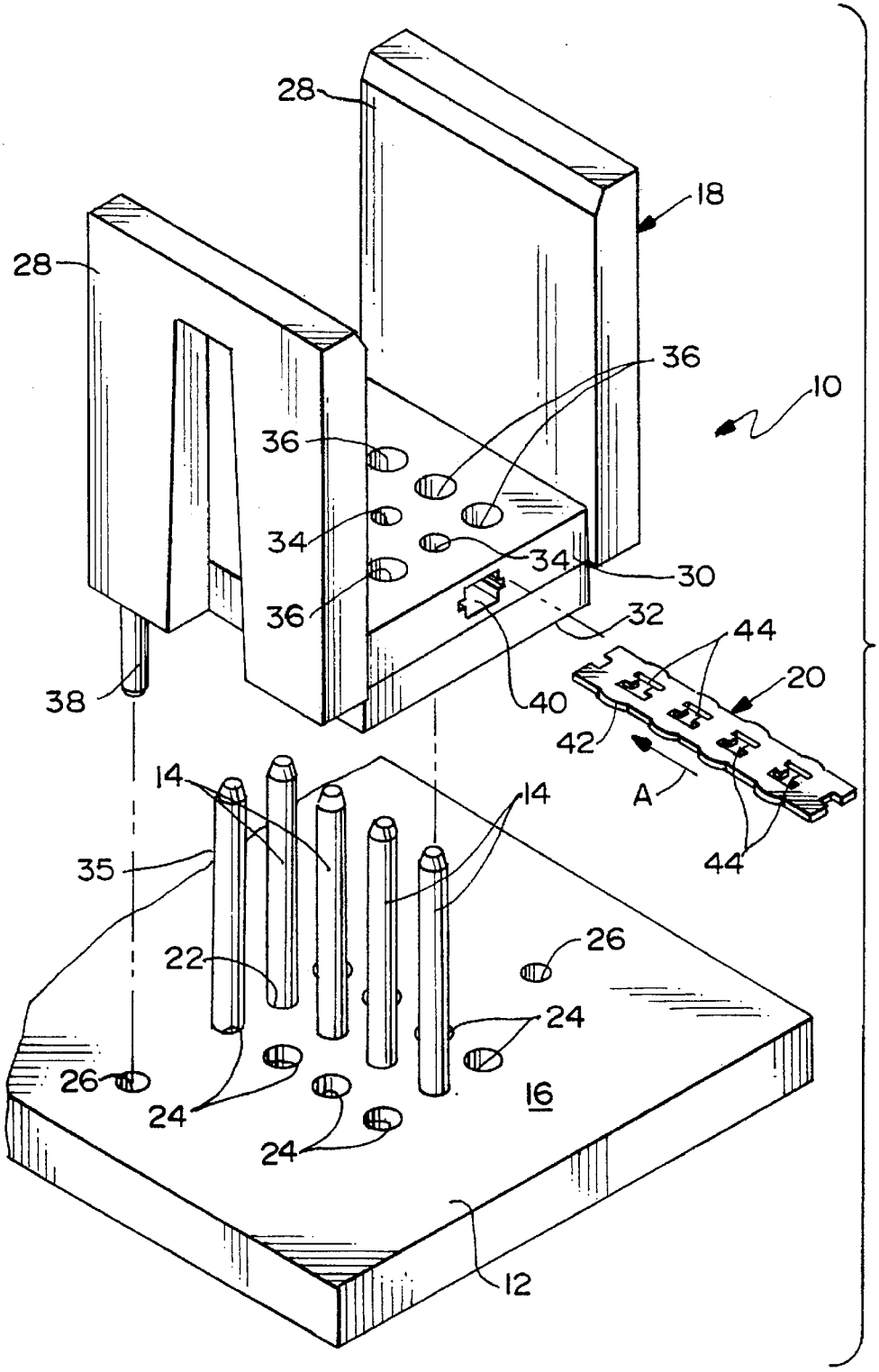
FIG. 1 is an exploded perspective view of the electrical pin field connector assembly of the invention.

Referring to the drawings in greater detail, and first to FIG. 1, the invention is embodied in an electrical pin field connector assembly, generally designated 10. The assembly includes a printed circuit board 12 having a plurality of contact pins 14 extending from one side 16 of the board. A housing, generally designated 18, is mounted over pins 14 and a locking member, generally designated 20, is assembled within the housing for mounting the housing to the pins projecting from the board.

More particularly, contact pins 14 are mounted through holes 22 in printed circuit board 12 and are electrically connected to circuit traces (not shown) on the board and/or in the holes. The pins are shown in a row between two rows of holes 24. In the exemplary embodiment herein, pins 14 are ground pins of connector assembly 10 for electrical connection to ground traces on the printed circuit board. Signal pins are inserted into holes 24 in the board for electrical connection to signal traces on the board and/or in the holes. The signal pins are not shown in the drawings in order to avoid unnecessarily cluttering the depiction of the invention. A pair of mounting holes 26 also are provided in printed circuit board 12 for purposes to be described hereinafter. Lastly, it should be understood that both the signal pins and the ground pins could extend from both opposite sides of the printed circuit board for mounting two housings thereon on the opposite sides of the board.

Figure 3:
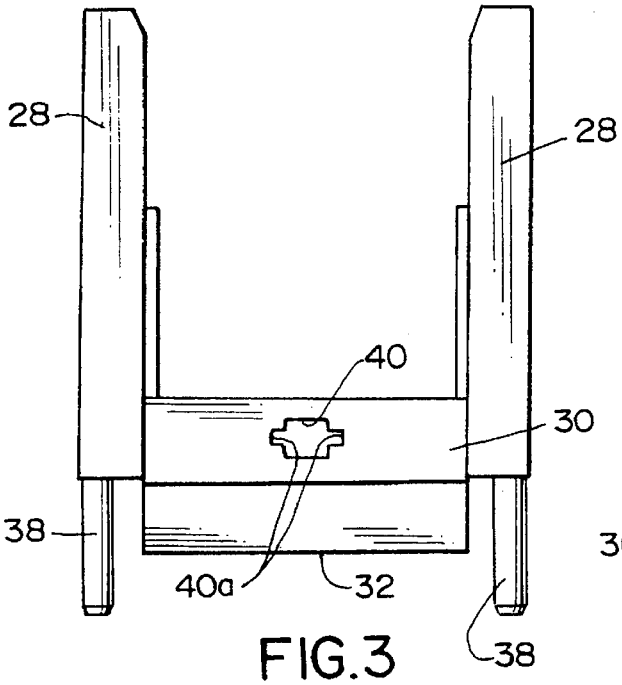
FIG. 3 is an end elevational view of the housing.
Figure 4:
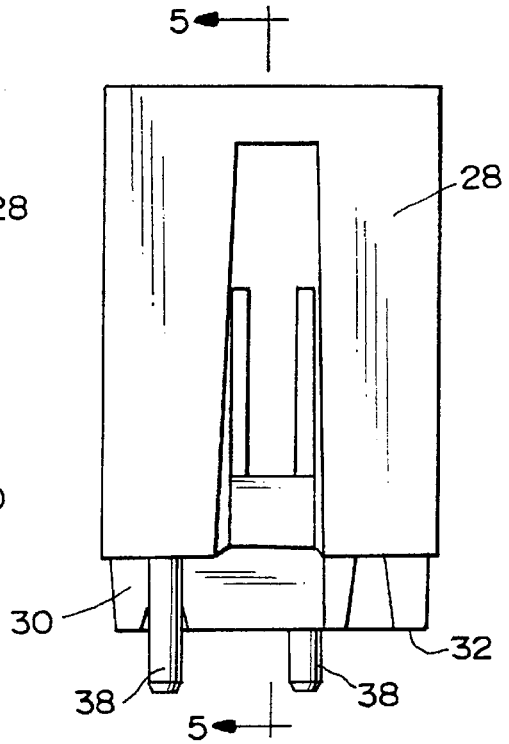
FIG. 4 is a side elevational view of the housing.
Figure 5:
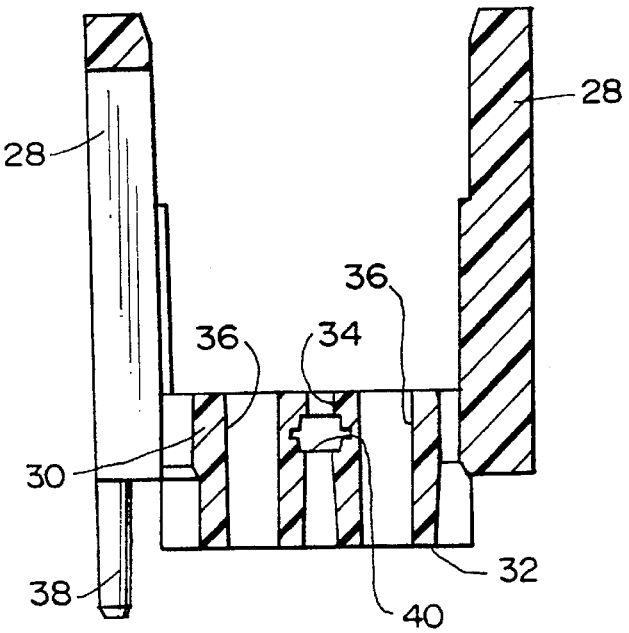
FIG. 5 is a vertical section taken generally along line 5—5 of FIG. 4.

Referring to FIGS. 3–5 in conjunction with FIG. 1, housing 18 is generally U-shaped and includes a pair of side wall portions 28 joined by a bottom wall portion 30 which defines a mounting face 32 of the housing. The bottom wall portion has a row of passages 34 through which ground pins 14 extend, and the row of passages 34 is between two rows of passages 36 through which the signal pins (not shown) extend. A pair of mounting pegs 38 project from mounting face 32 of housing 18 for insertion into mounting holes 26 in printed circuit board 12. Lastly, an internal channel 40 extends lengthwise through bottom wall portion 30 of the housing in such a manner that the channel longitudinally intersects the row of passages 34, generally parallel to side 16 of printed circuit board 12. In the exemplary embodiment of the invention herein, housing 18 is fabricated of conductive material, such as a die-cast metal material, to form a ground plane for the connector assembly and to shield the pins within the assembly.

Figure 2:
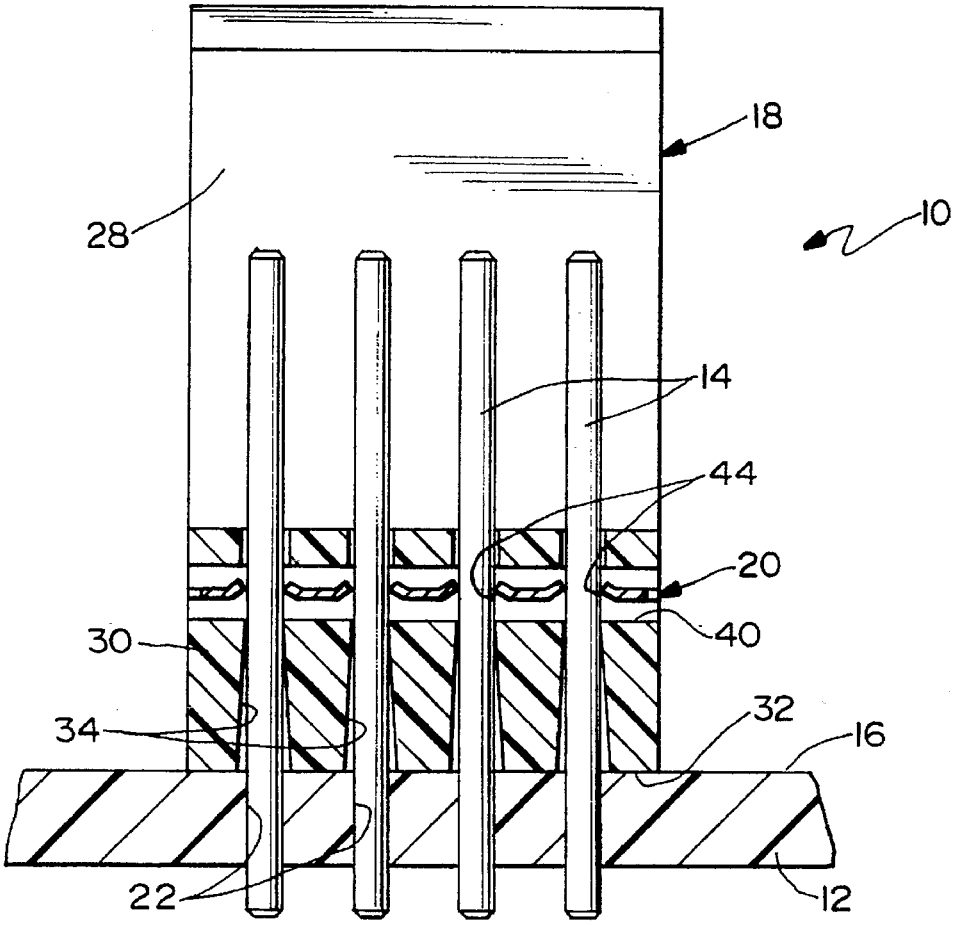
FIG. 2 is a vertical section through the assembly in a plane through the row of ground pins.
Figure 6:
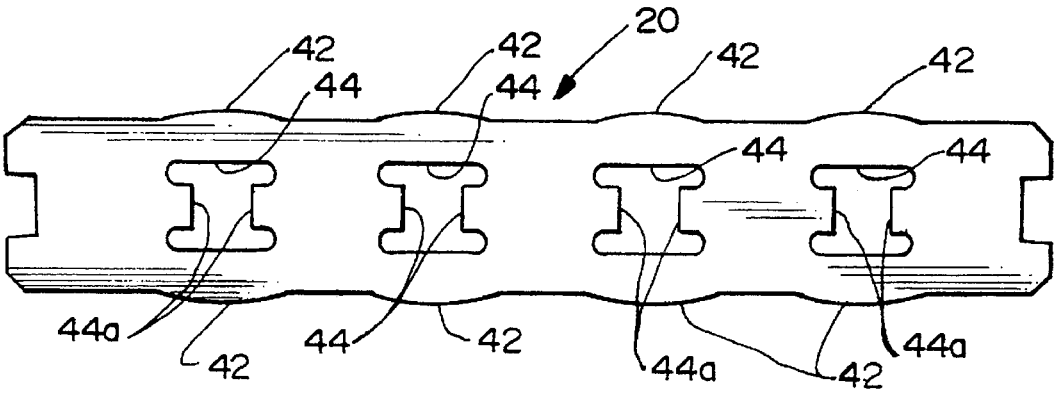
FIG. 6 is a plan view of the locking bar.

Referring to FIG. 6 in conjunction with FIG. 1, locking member 20 is in the form of an elongated locking bar that is inserted into channel 40 of housing 18 in the direction of arrow "A" (FIG. 1). FIGS. 2 and 5 show quite clearly how channel 40 longitudinally intersects the row of passages 34 that receive ground pins 14. Locking bar 20 is fabricated of conductive sheet metal material, and FIG. 3 shows that channel 40 is provided with thinner side wing portions or areas 40*a* which receive the side edges of the locking bar with an interference fit so that the bar does not fall out of the housing during assembly. The side edges of the bar are undulated to form rounded detent projections 42 as best seen in FIG. 6. These rounded detent projections facilitate providing the interference fit within wing areas 40*a* of channel 40.

FIG. 6 best shows that locking bar 20 is provided with a plurality of pin-gripping apertures 44. These apertures are aligned with passages 34 in housing 18 when the locking bar is properly assembled within the housing. The apertures have inwardly directed fingers 44*a* which are effective to grip pins 14. In essence, the distance between the inner edges of fingers 44*a* of any given aperture 44 is slightly less than the diameter of the respective pin received within the aperture. However, since locking bar 20 is fabricated of conductive sheet metal material, the fingers deflect slightly when the housing is mounted over the pins and, thereby, grip the pins and hold the housing onto the printed circuit board.

FIG. 2 shows electrical pin field connector assembly 10 in fully assembled condition. It can be seen how gripping apertures 44 of locking bar 20 are gripping pins 14. It also can be seen that mounting face 32 of the housing is abutting or at least in close proximity to side 16 of printed circuit board 12. The location of locking bar 20 allows for closely juxtaposing mounting face 32 to the printed circuit board. In other words, by disposing locking bar 20 within the confines of housing 18 (i.e. within internal channel 40), the locking bar does not interfere with closely positioning the housing onto the printed circuit board.

Lastly, FIG. 2 also shows that the lower ends of passages 34 are enlarged and tapered inwardly to provide enlarged mouths for the passages and, thereby, facilitate guiding the housing onto the pins. The tapered passages also minimize scraping the pins which could result in forming residue that might lead to unstable contacts. It also can be understood from FIG. 2 how a conductive ground path is formed from the conductive ground traces on the printed circuit board to pins 14 and, in turn, to conductive locking bar 20 and conductive housing 18.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical pin field connector assembly, comprising:

a printed circuit board having a plurality of pins projecting from at least one side thereof;

a housing mounted over the pins with a mounting face of the housing in close proximity to said one side of the printed circuit board, the pins extending through passages in the housing; and a locking member disposed within the confines of the housing and intersecting at least one of said passages, the locking member including a gripping aperture aligned with the one passage for gripping the respective pin that extends therethrough to hold the housing mounted over the pins with the mounting face in close proximity to the printed circuit board wherein said pins extending from the printed circuit board and said passages in the housing are in a row, and said locking member comprises an elongated locking bar having a plurality of said gripping apertures spaced lengthwise thereof for gripping a plurality of the pins and said locking bar is disposed in a channel in the housing that longitudinally intersects the row of passages in the housing.

2. The electrical pin field connector assembly of claim 1 wherein said housing is of conductive material.

3. The electrical pin field connector assembly of claim 2 wherein said locking member is of conductive material.

4. The electrical pin field connector assembly of claim 3 wherein said pins comprise ground contact pins.

5. The electrical pin field connector assembly of claim 1 wherein said locking member is of metallic material.

6. An electrical pin field connector assembly, comprising:

a printed circuit board having a row of ground pins projecting from at least one side thereof;

a conductive housing mounted over the pins with a mounting face of the housing in close proximity to said one side of the printed circuit board, the pins extending through a row of passages in the housing, the housing including a channel that longitudinally intersects the row of passages; and an elongated conductive locking bar disposed within the elongated channel within the confines of the housing, the locking bar including a row of gripping apertures aligned with the passages for gripping the pins that extend therethrough to hold the housing mounted over the pins with the mounting face in close proximity to the printed circuit board.

7. The electrical pin field connector assembly of claim 6 wherein said locking bar is fabricated of sheet metal material.

* * * * *